US007073448B2

(12) United States Patent
Bell

(10) Patent No.: US 7,073,448 B2
(45) Date of Patent: Jul. 11, 2006

(54) SHAPED CHARGE TUBING CUTTER

(75) Inventor: William T. Bell, Huntsville, TX (US)

(73) Assignee: Titan Specialties, Ltd., Pampa, TX (US)

( * ) Notice: Subject to any disclaimer, the term of this patent is extended or adjusted under 35 U.S.C. 154(b) by 0 days.

(21) Appl. No.: 10/700,221

(22) Filed: Nov. 3, 2003

(65) Prior Publication Data

US 2004/0206265 A1 Oct. 21, 2004

Related U.S. Application Data

(62) Division of application No. 10/017,116, filed on Dec. 14, 2001, now Pat. No. 6,644,099.

(51) Int. Cl.
*F42B 1/00* (2006.01)

(52) U.S. Cl. ..... 102/306; 102/307; 102/318; 102/319; 166/297

(58) Field of Classification Search ..... 102/306, 102/307, 308, 318, 319; 166/297
See application file for complete search history.

(56) References Cited

U.S. PATENT DOCUMENTS 3,599,567 A * 8/1971 Graham et al. ..... 102/319
3,872,709 A 3/1975 Pagano
4,184,430 A 1/1980 Mock
4,724,105 A * 2/1988 Owen ..... 264/3.1
4,881,445 A 11/1989 Hayes
4,883,118 A 11/1989 Preston
4,932,239 A 6/1990 Regalbuto
4,961,381 A * 10/1990 McLaughlin ..... 102/319
5,046,563 A * 9/1991 Engel et al. ..... 166/297
5,060,573 A 10/1991 Montgomery et al.
5,129,322 A 7/1992 Christopher et al.
5,241,891 A 9/1993 Hayes et al.
5,392,684 A * 2/1995 Renfro et al. ..... 89/1.14
5,780,764 A * 7/1998 Welch et al. ..... 102/318
5,992,289 A 11/1999 George et al.
6,016,753 A * 1/2000 Glenn et al. ..... 102/307
6,634,300 B1 * 10/2003 Reese et al. ..... 102/307

* cited by examiner

*Primary Examiner*—J. Woodrow Eldred
(74) *Attorney, Agent, or Firm*—W. Allen Marcontell

(57) ABSTRACT

A shaped charge tubing cutter includes a minimal contact suspension to isolate the cutter explosive from the housing and sub structure. A charge detonation booster main-cavity is located on the juncture of the charge truncation planes. Explosive in the booster main-cavity is detonated by a shielded primer path. Explosive density in the primer path is less than the main-cavity density. A dense, powdered metal SC liner and an abruptly stepped jet window in the tubing cutter housing improve performance. The axial span of the jet window is preferably aligned with the axial span between the liner bases. A testing apparatus and procedure inexpensively verifies downhole performance.

4 Claims, 8 Drawing Sheets

SHAPED CHARGE TUBING CUTTER

CROSS REFERENCE TO RELATED APPLICATIONS

This application is a Division of application Ser. No. 10/017,116, filed Dec. 14, 2001 now U.S. Pat. No. 6,644,099.

STATEMENT REGARDING FEDERALLY SPONSORED RESEARCH OR DEVELOPMENT

Not Applicable

BACKGROUND OF THE INVENTION

1. Field of the Invention

The present invention relates to shaped charge tools for cutting pipe and tubing. More particularly, the invention is directed to methods and apparatus for improving the performance and cutting reliability of shaped charge tubing cutters.

2. Description of Related Art

The capacity to quickly, reliably and cleanly sever a joint of tubing or casing deeply within a wellbore is an essential maintenance and salvage operation in the petroleum drilling and exploration industry. Generally, the industry relies upon mechanical, chemical or pyrotechnic devices for such cutting. Among the available options, explosive shaped charge (SC) cutters are often the simplest, fastest and least expensive tools for cutting pipe in a well. The devices are typically conveyed into a well for detonation on a wireline or length of coiled tubing.

Although simple, fast and inexpensive, SC cutters are reputedly not the most reliable means for cutting tubing downhole. State-of-the-art SC cutters are typically tested and rated for cutting capacity at surface ambient conditions. In field use, however, downhole well conditions may exceed 10,000 psi and 400° F. The impact of such elevated pressur and temperature has upon SC performance, generally, is not well understood. High pressure/temperature test environments for SC tubing cutters is not a norm of th industry. Industrial standards for SC cutter performance provide only for cutting capacity at standard atmospheric conditions.

Physical testing under simulated well conditions has revealed two primary influence factors affecting the cutting capacity of SC cutters:

(1) The spacial clearance between the cutter perimeter and the inside wall of the tubing; and, (2) Hydrostatic well pressure.

Asymmetric alignment of the SC cutter within the flow bore of the tubular subject of a cut may reduce the SC cutting capacity up to 35% under atmospheric conditions. At 15,000 psi, SC cutting capacity is reduced an additional 20–25%.

The graph of FIG. 1 illustrates the performance of a typical, 1 11/16" state-of-the-art SC tubing/casing cutter operating upon an L-80 grade, 4.7 lb./ft., 2 3/8" production tube. The abscissa axis of this graph plots the dimension of radial separation between the SC perimeter and the proximate tubing wall surface. When the SC cutter is aligned substantially coaxial with the tube, the clearance will be a uniform 0.15 in. around the SC perimeter as indicated by the dashed line coordinate that intersects the abscissa at the 0.15 in. value. The ordinate axis of the graph represents the wall penetration depth of an SC cutting jet. The dashed line coordinate from the ordinate axis represents the wall thickness of the tested tubing. The locus of curve "A" plots the SC performance at atmospheric pressure. The locus of curve "B" plots the SC performance at 15,000 psi.

To be noted from FIG. 1 is that even when the SC cutter is centrally aligned within the tube flow bore, the SC penetration capacity is marginal for completely severing the tube thickness at atmospheric pressure (curve A). When the pressure of the operational environment is raised to 15,000 psi, (curve B) the SC wall penetration capacity is substantially reduced. Similarly, when the SC is eccentrically misaligned with the tube axis wh reby one portion of the SC perimeter is in contact with the tube wall and the diametrically opposite portion of the SC perimeter has a 0.30 in. clearance, at atmospheric pressure the SC cutting capacity is reduced by 35%. Under 15,000 psi pressure, the cutting capacity is reduced by another 25% for a total of 60%.

Although SC cutter manufacturers offer centralizers for their tools and recommend their use, in field practice most cutters are operated without the use of a centralizer. However, such prior art centralizers are constructed of plastic or other low abrasion resistive material. Hence, such prior art centralizers are frequently damaged while running into a well by abrasion or by various restriction elements within the tubing bore. Consequently, a partial cut is the common result. As the data of FIG. 1 indicates, the penetration capacity of most cutters is marginal under optimum conditions and substantially lacking under severe conditions.

Another finding from test experiences is that SC cutters frequently lose penetrating capability when the cutter is mounted rigidly against the top sub of the tubing assembly or against the bottom of the SC cutter housing. The loss of cutting capacity is most severe when the SC is tightly coupled only on one side of the SC cutter. It would appear that the cutting jet generated by such a SC is asymmetrically formed due to such confinement. Such disruption of the normal jet formation also increases an undesirable flared distortion of the severed tubing wall at the separation plane and an undesirable deformation to the end face of the top sub.

In principle, the explosive assemblies of SC tubing cutters comprise a pair of truncated cones. The cones are formed as compressed powdered explosive material and joined along a common axis of revolution at a common apex truncation plane. The respective conical surfaces are faced or clad by a dense liner material; usually metallic. An aperture along the common conical axis accommodates a detonation booster.

In theory, ignition of the detonation booster initiates the SC explosive along the cone axis. Explosive detonation propagates a rapidly moving pressure wave radially from the axis through the two explosive material cones. Traveling radially from the con axis, the pressure wave first ncounters the charge lin r at the truncat d apex plane and progresses toward the conical base. As the two liners erupt from the conical surface into th proximate window space, heavy molecular material from the respective charge liners collide with substantially equal impulse along the common juncture plane. Since there is an included angle between the liners, the resulting vector of this collision is a substantially planar jet force issuing radially from the cone axis.

In sequence, the explosive material decomposes more rapidly than the liner material. Hence, the explosive material is transformed into a high pressure gaseous mass confined behind the liner barrier. I have discovered that if a portion of that gas escapes into the jet cavity between the conical liners in advance of the liner material merger, the intensity and direction of the cutting jet is compromised.

It is an object of the present invention, therefore, to provide the industry with tubing cutters having a substantially known downhole, high pressure cutting capacity.

Also an object of the present invention is to disclose a test method for quickly and inexpensively determining the cutting capacity of a cutter assembly under downhole conditions.

A further object of the invention is a cutter assembly design that reliably confines the decomposing SC explosive behind the SC liner to prevent distortion of the cutting jet development.

Another object of the invention is a reliable centralizer assembly.

Also an object of the invention is a new detonator booster design that ignites the SC booster substantially along the cone axis of the charges and at the common plane of apex truncation.

A further object of the invention is provision of an SC tube cutter explosive liner having deeper and more effective cutting capacity.

SUMMARY OF THE INVENTION

These and other objects of the invention as will become apparent from the following d tailed description are provided by an SC assembly wherein the explosive unit of the assembly is substantially isolated between the end wall of the assembly top sub and the inside end-face of the housing by respective spaces of about 0.100" or more. A plurality of metallic dowel pins protruding from the end face of the top sub engage the adjacent face of the SC thrust plate. Preferably, the thrust plate is brass or other non-ferrous material whereas the spacer pins may be steel. At the housing end, the SC end plate may be ferrous but separated from the housing end wall by a non-conductive elastomer washer that resiliently biases the SC explosive against the top sub dowel pins.

The invention housing is a generally cylindrical element of hardened, high-strength steel having structural weakness or failure lines formed about the housing perimeter above and below the cutting jet window. Internally of the housing, a cutting jet window is defined about the inside perimeter of the housing by concentric channeling. An outer channel having substantially radial walls spans an inner channel, also having substantially radial walls. The axial span between the outer radial window walls is coordinated to the axial span between the conical base perimeters of the SC explosive unit liners whereby the edge thickness of the liner base is intersected by the radially projected plane of the outer window wall.

Externally, the SC housing is formed to an axially projecting salient for secure attachment of a centralizer having spring steel centralizing blades whereby the blades have significant abrasion resistance and are free to flex without exceeding material yield limits.

The SC explosive unit is lined with a pressure formed powdered metal mixture comprising about 80≧% tungsten with the remainder comprising a mixture of about 80% copper and about 20% lead powders. The liner cladding is formed to an approximate 0.050" thickness.

A cylindrical aperture is formed along the explosive unit axis to receive a detonation booster comprising a substantially cylindrical brass casement having an elongated, small diameter axial primer channel into a large diameter main cavity. High explosive powder in the primer chann l is packed to a density of about 1.1 to about 1.2 g/cc whereas the main cavity explosive is packed to about 1.5 to about 1.6 g/cc. Axially opposite of the prim r channel entry into the main cavity, the main cavity is volume defined by a brass plug insert. The detonation booster casement is positioned along the axial aperture to locate the juncture plane of the apex truncations across the approximate center of the booster main cavity. The booster casement wall thickness along the length of the primer channel is sized to prevent detonation of the SC explosive by the primer decomposition.

Also within the scope of the present invention is a highly simplified test procedure for testing cutter performance within a pressure vessel and for determination of an associated relationship between the cutting performance of a tool at atmospheric pressure and the cutting capacity of the same tool at some designated downhole pressure.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DESCRIPTION OF THE PREFERRED EMBODIMENTS

Figure 1:
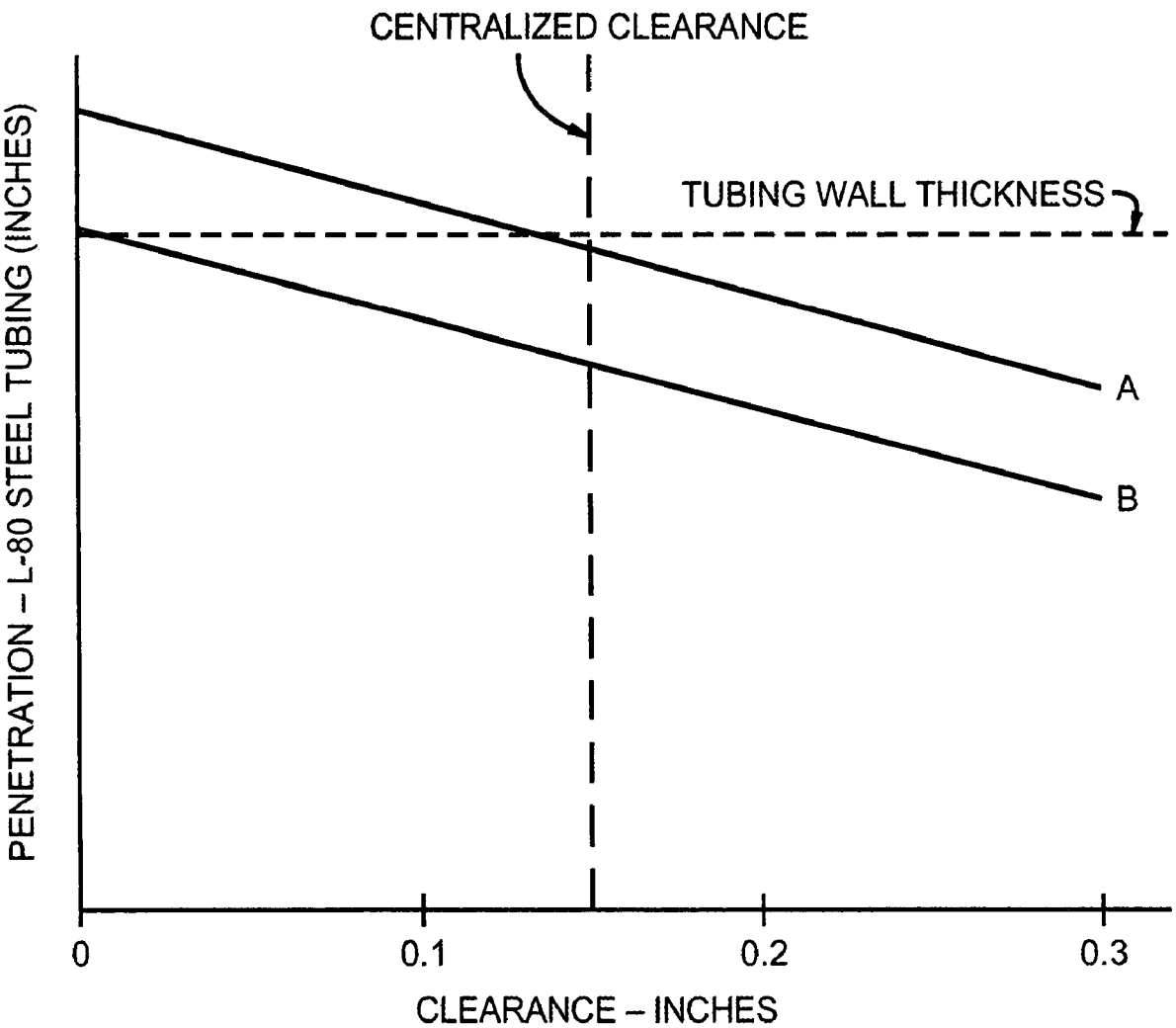
FIG. 1 is a graph of cutting performance data observed from tests of prior art SC cutters.
Figure 2:
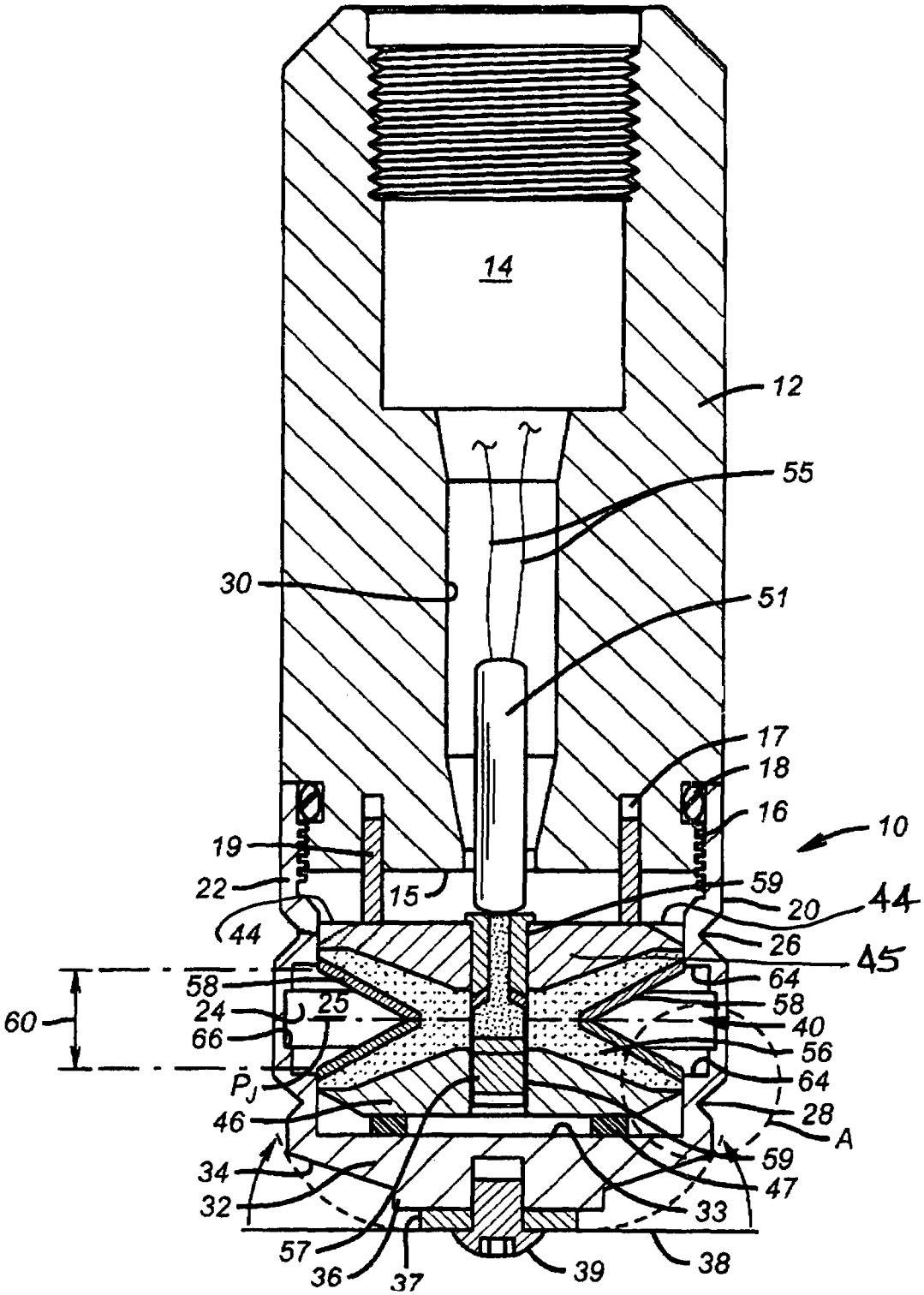
FIG. 2 is a cross-section of one embodiment of the invention.

Referring initially to the invention embodiment of FIG. 2, the cutter assembly 10 comprises a top sub 12 having a threaded internal socket 14 for secure assembly with an appropriate wire line or tubing suspension. In general, the cutter assembly has a substantially circular cross-section. Consequentially, the outer configuration of the cutter assembly is substantially cylindrical. The opposite end of the top sub includes a substantially flat end face 15 having dowel sockets 17 for receipt of spacer pins 19. The end face perimeter is delineated by a housing assembly thread 16 and an O-ring seal 18. The axial center of the top sub is bored between the assembly socket 14 and the end face 15 to provide a detonator socket 30.

Figure 6:
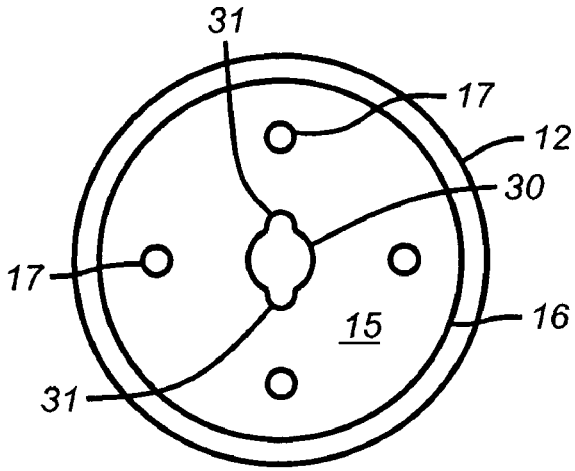
FIG. 6 is an end view of the assembly top sub.

Occasionally, when operating tubing cutters, the detonator socket 30 becomes plugged with debris from the detonator, its holder and debris from the well. Resultantly, pressure is trapped within the top sub which presents a personnel hazard when disassembling the tool upon recovery from the well. Responsively, the present invention provides a pair of supplementary vents 31 as illustrated by FIG. 6 alongside the detonator socket 30 as pressure bleed-off vents.

Referring again to FIG. 2, the present invention cutter housing 20 is secured to the top sub 12 by an internally threaded sleeve 22. An O-ring 18 seals the interface from fluid invasion of the interior housing volume. A jet window section 24 of the housing interior may be axially delineated above and below by exterior "break-up grooves" 26 and 28. The break-up grooves are lines of weakness in the housing 20 cross-section and may be formed within the housing interior as well as exterior as illustrated. The jet window 24 is that inside wall portion of the housing 20 that bounds the jet cavity 25 around the SC between the liner faces 58.

Below the lower break-up groove 28 is an end-closure 32 having a conical outer end face 34 around a central end boss 36. A hardened steel centralizer 38 is secured to the end boss by an assembly bolt 39, A spacer 37 may be placed between the centralizer and the face of the end boss 36 as required by the specific task.

Preferably, the shaped charge housing 20 is a frangible steel material of approximately 55–60 Rockwell "C" hardness. Prior art common steel cutter housings usually break up adequately so that debris will fall harmlessly to the bottom of the well when fired at low hydrostatic pressures. However, when fired at elevated pressures, the prior art material may fail to fragment satisfactorily, thus plugging the tubing bore in which it is fired. More seriously, the threaded sleeve section of a mild steel cutter housing may simply flare to a larger diameter when the SC is discharged. If the diameter increase is excessive, the top sub of the cutter housing cannot be retrieved through some restrictions that are commonly installed in the tubing string above the cut, thereby resulting in an expensive and time consuming fishing operation to recover the tool remainder. By utilizing a hard, frangible steel material for the housing fabrication, fragmentation of the housing 20 is encouraged and flaring is minimized or eliminated.

Figure 5:
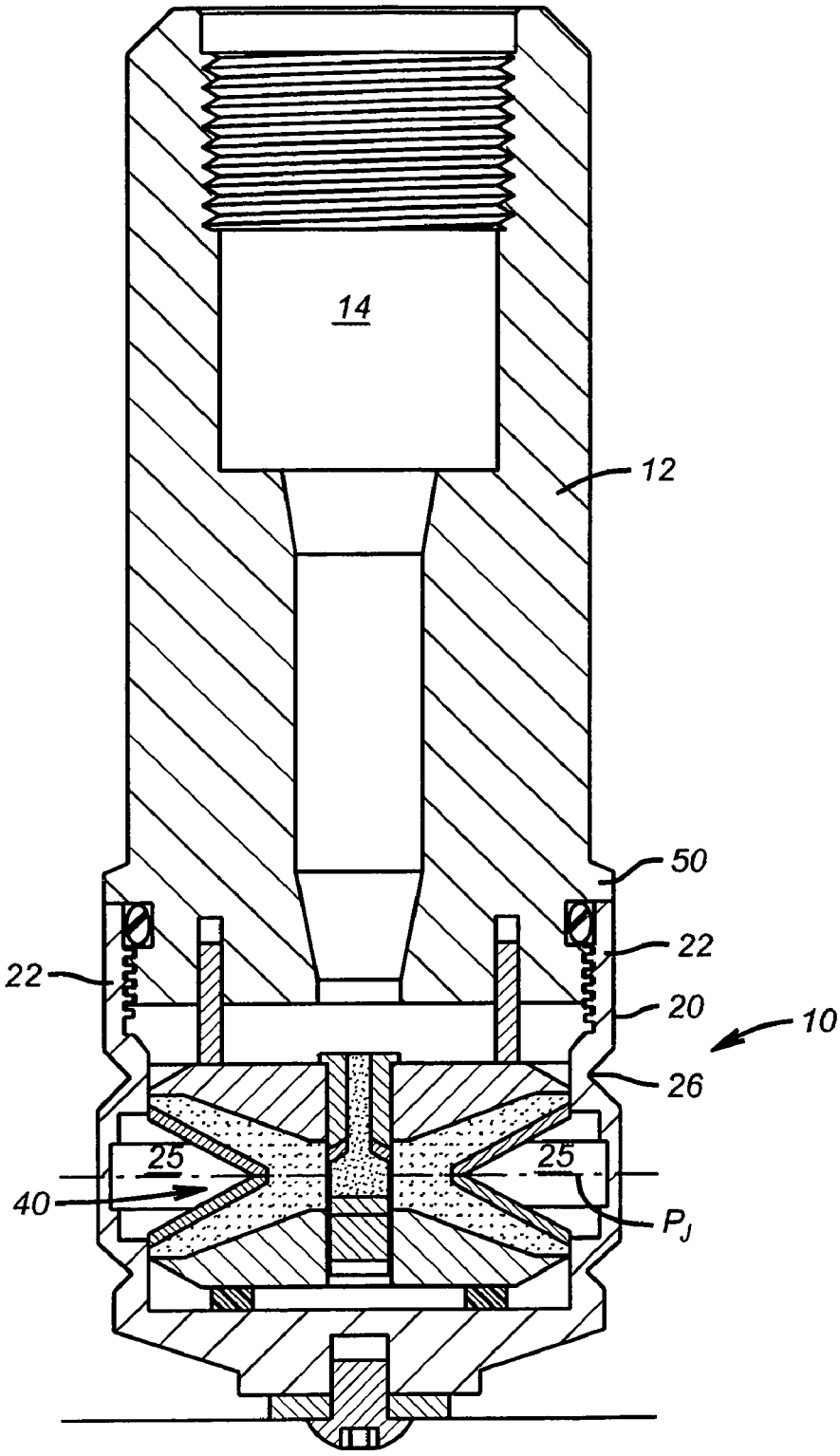
FIG. 5 is a cross-section of an additional embodiment of the invention.

The flaring consequence of a cutter discharge may also visit the end face of the top sub 12. The detonation forces may radially curl or flare the intersecting corner between the end face 15 and the top sub OD surface. Such added radial dimension to the top sub may also prevent recovery of the tool following the tubing cut thereby requiring a fishing operation. As shown by the FIG. 5 embodiment of the invention, a relatively narrow shear shoulder 50 is formed in the top sub body to seat the end face of the cutter housing sleeve 20. The shear shoulder base is sized to accommodate the normal static loads on the housing sleeve but to separate under the shear loads imposed by detonation.

Figure 3:
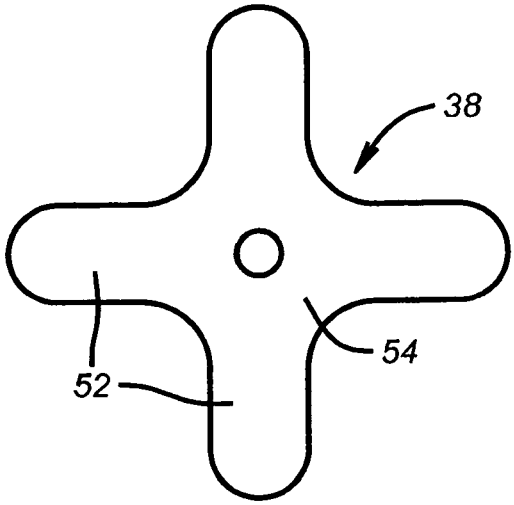
FIG. 3 is a plan view of the present invention centralizer.

Prior art tool centralizers are often damaged when running into a well by being forced past certain tubing restrictions without accommodation for sufficient flexure within the yield limits of the centralizer material. The present invention centralizer 38 shown in plan by FIG. 3 comprises 3 or more, in this case 4, centralizing arms 52 radiating from a central body 54. Preferably, the centralizer 38 is fabricated from thin, spring-steel stock. Returning to FIG. 2, the centralizer is firmly secured to a projecting end of the cutter housing 20 by a machine screw 39, for example. This projecting end mount permits the centralizer arms 52 to pass through the restrictions before engaging the cutter housing 20. The conical surface relief of the housing end face 34 coupled with the projection from the outer perimeter of the end-closure 32 provided by the end boss 36 and the thickness of the spacer 37 allows the centralizer arms sufficient free deflection space to pass the tubing restrictions without exceeding deformation stress by forcing the arms to pass between the outer perimeter edges and internal tubing restrictions.

The shaped charge assembly 40 is preferably spaced between the top sub end face 15 and the inside bottom face 33 of the end closure 32 by spacers. An air space of at least 0.100" between the top sub end face 15 and the adjacent face of the cutter assembly thrust disc 44 is preferred. Similarly, it is preferred to have an air space of at least 0.100" between the inside bottom face 33 and the adjacent cutter assembly end plate 46. The FIG. 2 invention embodiment provides a plurality of steel (for example) positioning pins 42 inserted into dowel sockets 17. The pins 42 project from the end face 15 for a stand-off compression engagement of the brass (for example) thrust disc 44 top face. An elastomer compression washer 47 spaces the adjacent faces 33 and 46. The material composition of these components is addressed to a non-sparking environment. Other materials may be used that are functionally relevant to the invention operation.

State-of-the-art tubing cutters have been provided with a steel compression spring bias against the shaped charge assembly. However, such arrangements represent substantial safety compromises when bearing upon a steel or ferrous metal thrust disc 44 and/or end plate 45 or 46 due to the difficulty in maintaining the cutter housing interior free of loose particles of explosive. Loose explosive particles can be ignited by impact or friction in handling, bumping or dropping the assembly. Ignition that is capable of propagating an explosion may occur at contact points between a steel thrust disc 44 or ferrous metal end plates 45 or 46 and a steel housing 20. To minimize such ignition opportunities, the thrust disc 44 and end plates 45 and/or 46, for the present invention, are preferably fabricated of non-sparking brass. Assuming the thrust disc 44 is brass, the positioning pins 19 may consequently be formed from steel or other ferrous material. If the compression washer 47 is an elastomeric or other non-ferrous material, the end plate 46 may be a ferrous material. Conversely, if the resilient bias on the assembly is provided by a ferrous spring such as a bellville washer type not shown, the end plate 46 material should be non-ferrous.

As a further alignment control means, the outside perimeter diameter of the brass thrust disc 44 may be only slightly less than the inside diameter of the housing 20 to assure centralized alignment of the explosive assembly within the housing 20. The end plates 45 and/or 46, on the other hand, which may be formed of a ferrous material, should have an outside perimeter diameter less than the inside diameter of the steel housing to avoid a steel-to-steel contact.

The shaped explosive charge 56 that is characteristic of shaped charge tubing cutters comprises a precisely measured quantity of powdered form explosive material such as RDX or HMX that is formed into a truncated cone against the conical faces respective to a pair of end plates 45 or 46. An axial bore space 59 through the thrust disc 44, end plates 45 and 46 and explosive material 56 is provided to accommodate a detonation booster 57. The taper face explosive cones of the present invention are clad with a high density, pressed, powdered metal liner 58 comprising about 80≧% tungsten and an approximate 80/20% mixture of copper and lead powders. A representative liner thickness may be about 0.050". As understood by those skilled in the art, shaped charge penetration capability increases with (a) an increase in liner density and (b) a pressed powder liner material. A pair of such conical units is assembled in peak-to-peak opposition along a common apex truncation plane $P_J$.

Figure 4:
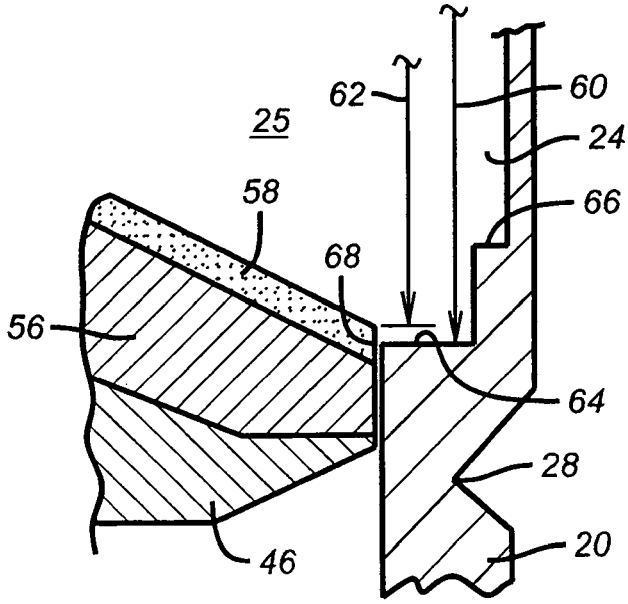
FIG. 4 is a detailed section of cutter perimeter and jet window

With respect to FIG. 4, the axial span 60 of the charge between the liner base perimeters 68 adjacent the inside wall of the housing 20 is closely correlated to the axial span 62 of the jet window 24 between the opening walls 64. See FIG. 4. Preferably, the window wall 64 will be aligned about midway of liner 58 thickness at the perimeter base 68. Cutting jet formation may be disrupted due to explosive forces spilling prematurely past the liner base 68 into the jet cavity 25. As a consequence, jet penetration may be reduced to fractional levels or to none at all. This disfunction is reduced by providing a jet window span 62 about 0.050" greater than the liner span 60 to align the outer jet window wall 64 within the thickness of the liner base perimeter 68. Apparently, the proximity of the liner base perimeter 68 to the inside wall of the housing 20 shields explosive forces from entering the jet cavity 25.

If the span 60 of the liner base perimeter 68 significantly exceeds the span 62 between the window walls 64, however, collapsing liner elements 58 may strike the window wall 64 corner thereby wiping off the rear portion of the jet. As a consequence, jet penetration is reduced. Referring to FIG. 4, an efficient compromise of these critical parameters could place the outer window walls 64 as coinciding with the SC liner bases 68 at about mid-thickness.

The second "step" of the jet window 24 is delineated within the outer walls 64 and between the inner walls 66. This second step has been found to deflect reflected shock waves that disrupt jet formation and reduce jet penetration.

Following the traditional operating sequence and returning the descriptive reference to FIG. 2, the SC detonator 51 is ignited by an electrical discharge carried by conduits 55 from the surface. Ignition of the detonator 51 triggers the ignition of the booster 57. The booster 57 explosive decomposes with a greater shock pulse than the detonator 51 explosive but requires the moderately explosive shock provided by detonator 51 for initiation. Ignition of the booster 57 detonates the shaped charge explosive 56 resulting in enormously high explosion pressures (2 to $4\times10^6$ psi) on the powdered metal liner 58. The resulting high pressures collapse the liner inwardly thereby merging the liner elements along the common geometric plane $P_J$ thereby resulting in a high speed jet of liner material which is propelled radially outward at velocities in excess of 15,000 ft/sec. The high velocity of the jet cuts through the housing 20 and continues outwardly to cut through the wall of the tubing or casing surrounding the SC.

It is a generally accepted axiom of the art that to extract maximum cutting effectiveness, the cutter charges 56 must be initiated on the geometric plane of juncture $P_J$ between the two conical forms. Initiation at this point releases balanced forces within the charge and generates a coherent jet radially outward along the juncture plane substantially normal to the cutter axis.

Figure 7:
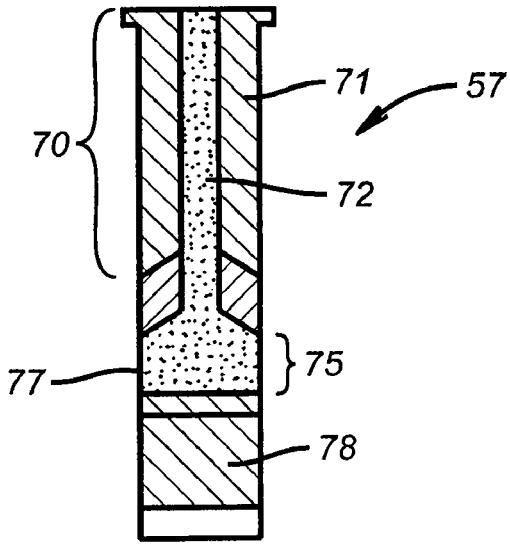
FIG. 7 is an axial cross-section of the present invention detonation booster.

With respect to FIGS. 2 and 7, the present invention detonation booster 57 is configured to shield the explosive charges 56 from a detonation energy level except within an immediate proximity of the charge juncture plane $P_J$. The booster casement body is preferably turned from an intermediate to high density material that is relatively strong such as brass. The primer section 70 (see FIG. 7) includes an annular wall 71 with a thickness of about 0.080" to about 0.100" or sufficiently thick to prevent cross-initiation by such low energy levels as 2 and above. The primer section wall surrounds an axial bore 72 having an inside diameter of about 0.045" to about 0.080" that is large enough to sustain a high order initiation and set off explosive in the main cavity 75 but at the same time, is small enough to contain a quantity of explosive (about 10 to about 20 grains/ft. of RDX) that is inadequate to initiate the explosive charges 56 prior to the main cavity detonation. A representative primer explosive density may be about 1.1 to about 1.2 g/cc.

Typically, the main cavity 75 is about 0.156" long (FIG. 7). The inside diameter of the main cavity may be maximized for confining a maximum quantity of RDX explosive at the juncture plane $P_J$ (FIG. 2). The main cavity explosive is packed more densely than in the primer train. For example, the main cavity explosive may be packed to about 1.5 to about 1.6 g/cc. The casement wall around the main cavity is about 0.010 in. thick or as thin as practicable (FIG. 7).

The main cavity bore of the booster casement is closed by a pressed plug 78 having sufficient mass (density/weight/length) to terminate the explosive initiation and to direct the explosive energy laterally.

When fired in the usual fashion, the booster primer section 70 (FIG. 7) detonates along the small diameter bore 72 to initiate the larger main detonation cavity 75. Explosive energy from the main cavity 75 ignites the SC explosive 56 on the juncture plane. The primer section construction prevents cross-firing of the SC charge because of the low explosive weight in the primer bore 72 combined with a thick, energy absorbing wall 71. Premature ignition of the explosive in the main detonation cavity 75 is arrested by a high density and strong energy absorbing plug 78. This plug 78 prevents cross-firing of the charge on the opposite side of the charge juncture plane from the detonator. When the detonation front impacts the plug 78, initiating energy is prevented from progressing downward. Moreover, detonation pressure is increased due to impact with the solid boundary of the plug. That elevated pressure is reflected laterally to the SC explosive thereby significantly enhancing initiation efficiency at the desired initiation aperture.

The current state-of-the-art quality control test for well tubing cutters is to place a cutter into piece of "standard" field tubing such as 2⅜" OD, 4.7 lb/ft., J-55 pipe or 2⅞" OD, 6.5 lb/ft, J-55 pipe and fire the cutter. The cutter is usually centralized, in water and at atmospheric conditions for firing. If the tubing is severed, the test is considered successful.

As explained previously, however, cutter performance is influenced by two major factors: a) clearance between the cutter and the wall of the tubing (up to 35% penetration reduction) and b) hydrostatic pressure in the well (up to 25% reduction at pressure levels of 15,000 psi and greater). Consequently, the present invention has devised a simple but effective test procedure to monitor the actual penetration value of a cutter configuration under simulated extreme conditions.

Figure 8:
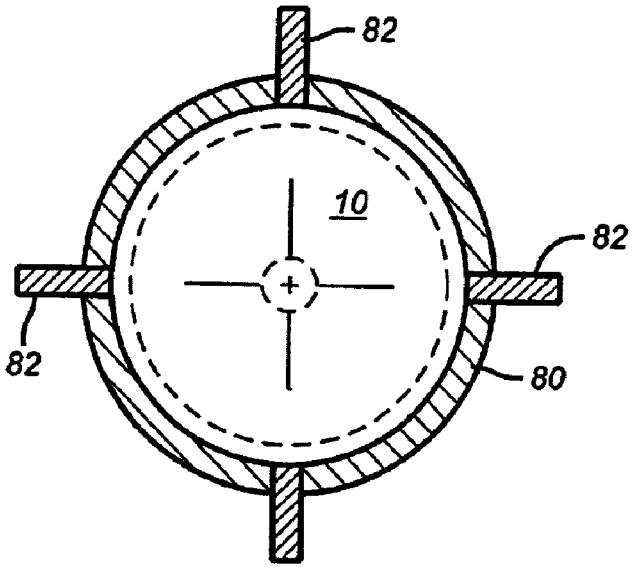
FIG. 8 is a sectioned plan view of the FIG. 9 test apparatus.
Figure 9:
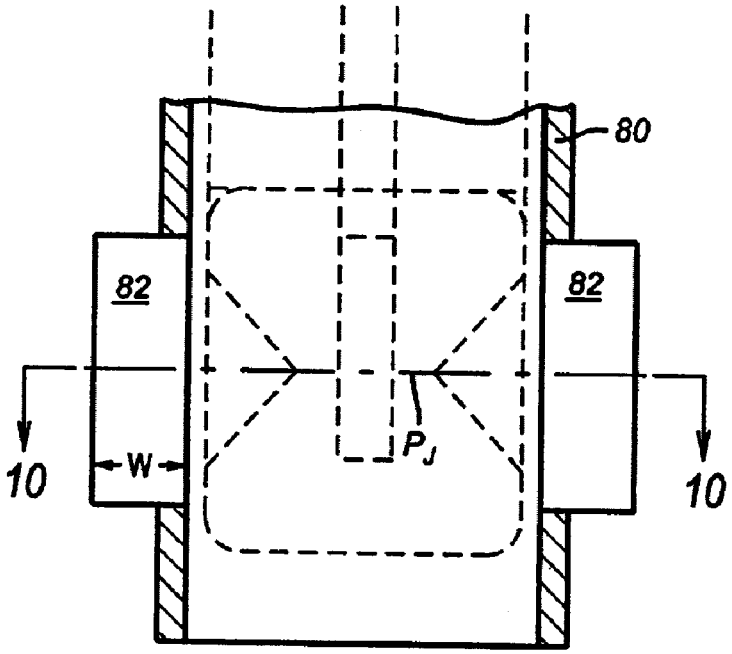
FIG. 9 is a sectioned view of the present test apparatus.

To this end, the cutter 10 is inserted centrally within a test assembly such as that illustrated by FIGS. 8 and 9 and fired. The test assembly may comprise a representative section of tubing 80 having 4, for example, steel "coupons" 82 secured as by welding, for example, within longitudinal slots in the sample tube wall. The coupons 82 are preferably, of the same alloy as the tubing 80. The radial depth of the coupons, dimension "W" in FIG. 9, is preferably greater than the deepest possible penetration of the cutting jet. The assembly may be immersed in a desired fluid atmosphere and enclosed by a pressure vessel. The pressure vessel is charged to the anticipated operating pressure such as a bottomhole well depth pressure and fired.

After firing, penetration of the coupons 82 and tubing wall 80 is measured at different points radially (along dimension W) around the test assembly, checking for radial integrity in the coupons as well as in the pipe. At the same time, the character of the cut is noted. The penetration values are then compared with minimum penetration requirements established by taking into account the factors defined previously.

Figure 10:
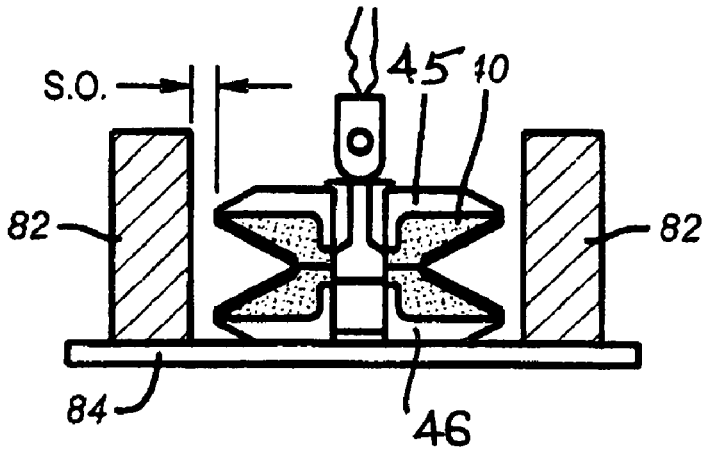
FIG. 10 is a sectioned view of a simplified alternative test apparatus.
Figure 11:
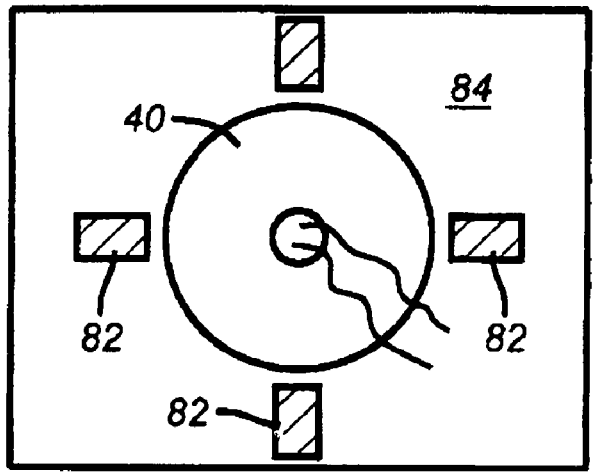
FIG. 11 is a plan view of the FIG. 10 test apparatus.

A simplified and less expensive alternative to the foregoing test procedure is represented by FIGS. 10 and 11 which utilizes the same coupons 82 secured (as by welding, for example) to a base plate 84 as radial elements about a circle. The SC, independent of a housing 20 enclosure, is positioned within the interior circle at a substantially concentric stand-off (dimension S.O.) from the interior edge of the coupons 82 and discharged.

Figure 12:
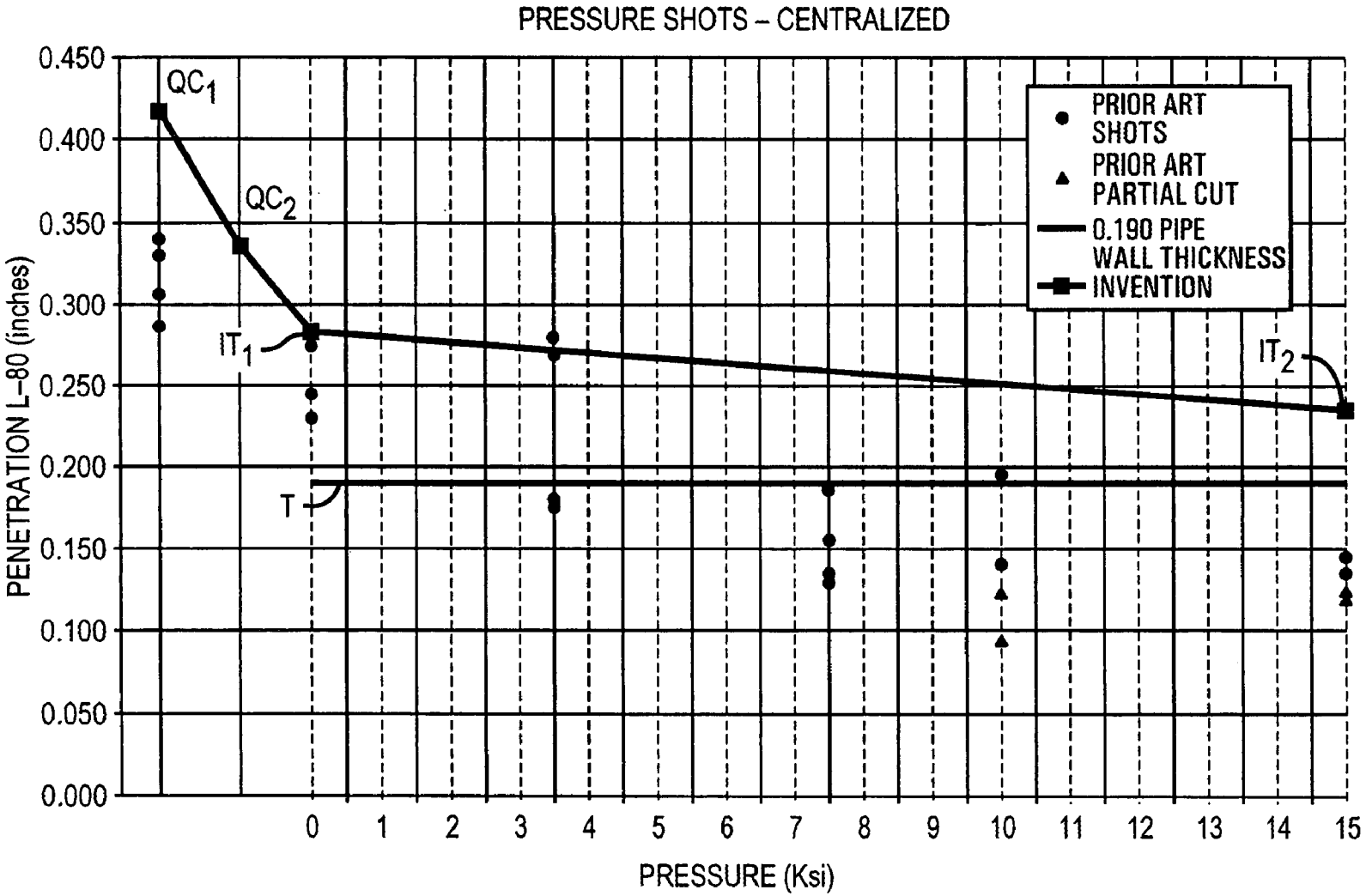
FIG. 12 is a graph of SC performance under various conditions.

The graph of FIG. 12 illustrates an actual application of the two procedures described above. The tubing 80 object of the test was an L-80 alloy having a mid-range strength and standard wall thickness as specified by the API for perforator testing. Radial penetration dimension is represented linearly along the ordinate axis. Environmental pressure on the test shot is represented in units of 1000lbs/in$^2$ (ksi) along the abscissa. The solid line "T" represents the tube wall thickness dimension of 0.190". The test included two basic sets of environmental conditions: a) at ambient temperature and pressure and b) at the rated downhole temperature and pressure. The shot point designated on the graph as $QC_1$ results from a FIG. 10 test apparatus. The graph point $QC_1$, reports the average coupon penetration by the 1 11/16" shaped charge test subject without the housing 20 and with no (zero) clearance between the SC perimeter and the coupon 82 edge. The shot point designated as $QC_2$ also results from a FIG. 10 test method and reports the average coupon penetration by a 1 11/16" shaped charge test subject in assembly with a stand-off dimension S.O. corresponding to the average radial distance between the perimeter of the SC thrust disc 44 perimeter and the inside wall of a tubing 80. The shot points designated as $IT_1$ and $IT_2$ on the FIG. 12 graph report the SC penetration of coupons 82 set in the manner illustrated by FIGS. 8 and 9. Shot point $IT_1$ was made under atmospheric P/T conditions whereas shot $IT_2$ was made under 15 kps pressure.

From an analysis of the FIG. 12 graph, it is readily seen that a 1 11/16" cutter requires a 0.380" penetration of L-80 steel at atmospheric conditions to reliably cut the same 0.190" tubing wall thickness at 15,000 psi.

Other data points on the FIG. 12 graph represent shots made under the charted conditions by prior art assemblies. Notably, the shots designated by a "diamond" ♦ resulted in a severed tubing. However, the tubing separation was not entirely due to SC jet. A portion of the cut was due to spalling.

Although our invention has been described in terms of specified embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention

The invention claimed is:

1. A shaped charge tubing cutter comprising a pair of substantially matched explosive units respectively formed about an axis of revolution into substantial cones having a normally truncated apex, said cones being joined coaxially at said truncated apex along a common juncture plane, an aperture within said units substantially along said axis and crossing said juncture plane for receipt of a detonation booster, said explosive units being encased within a substantially cylindrical housing having an internal jet window between conical base planes of said explosive units, said jet window comprising at least a pair of circumferential channels about a cylindrical interior wall of said housing, one of said channels having a greater inside diameter than the other and the other of said channels having a greater axial length between substantially radial sidewalls, said one channel being disposed between the sidewalls of said other channel.

2. A shaped charge tubing cutter comprising a pair of substantially matched explosive units respectively formed about an axis of revolution into substantial cones having a normally truncated apex, said cones being joined coaxially at said truncated apex along a common juncture plane, an aperture within said units substantially along said axis and crossing said juncture plane for receipt of a detonation booster, said explosive units being encased within a substantially cylindrical housing said housing being secured to a substantially cylindrical top sub, said top sub having a substantially axial aperture aligned with the axis of revolution of said explosive units for receipt of a detonator, said axial aperture having at least one lateral pressure vent.

3. A shaped charge tubing cutter comprising a pair of substantially matched explosive units, each unit being formed about an axis of revolution into a substantially normal cone having a substantially normal base plane and truncated apex, said cones being joined coaxially at said truncated apices along a common juncture plane, an aperture within said joined units extending substantially along said axis and crossing said juncture plane for receipt of a detonation booster, said joined units being encased within a substantially cylindrical housing, said cylindrical housing comprising an axial projection from a closed distal end of said housing having an external perimeter less than an external perimeter of said cylindrical housing, and a tool centralizer comprising a planar element secured to said projection by a single fastener proximate of said axis, said planar element having a plurality of substantially planar spring blades disposed substantially normal to said axis of revolution for flexure about said fastener.

4. A shaped charge tubing cutter comprising a pair of substantially matched explosive units, each unit being formed about an axis of revolution into a substantially normal cone having a substantially normal base plane and a truncated apex, said cones being joined coaxially at said truncated apex along a common juncture plane, an aperture within said joined units extending substantially along said axis and crossing said juncture plane for receipt of a detonation booster, said joined units being encased within a substantially cylindrical housing having a substantially conical end closure projecting axially from a distal end of said housing, and a centralizer comprising a resilient, structurally integral, planar element having a plurality of blades extending radially from said axis of revolution within a plane that is substantially normal to said axis, said planar element being secured to said conical end closure by a single fastener proximate of an apex of said conical end closure for permitting said blades to flex about said single fastener without engaging circumferential housing structure.

* * * * *